US006991439B2

(12) United States Patent
Ishikawa

(10) Patent No.: US 6,991,439 B2
(45) Date of Patent: Jan. 31, 2006

(54) VACUUM PUMP

(75) Inventor: Takaharu Ishikawa, Chiba (JP)

(73) Assignee: BOC Edwards Technologies Limited, Narashino (JP)

( * ) Notice: Subject to any disclaimer, the term of this patent is extended or adjusted under 35 U.S.C. 154(b) by 75 days.

(21) Appl. No.: 10/385,186

(22) Filed: Mar. 10, 2003

(65) Prior Publication Data

US 2003/0175132 A1 Sep. 18, 2003

(30) Foreign Application Priority Data

Mar. 13, 2002 (JP) ..... 2002-068537

(51) Int. Cl.
*F04B 17/03* (2006.01)

(52) U.S. Cl. ..... 417/423.4
(58) Field of Classification Search ..... 415/90; 417/423.4
See application file for complete search history.

(56) References Cited

U.S. PATENT DOCUMENTS 5,971,725 A * 10/1999 de Simon et al. ..... 417/423.4
6,644,938 B2 * 11/2003 Omori ..... 417/423.4

* cited by examiner

*Primary Examiner*—Michael Koczo, Jr.
(74) *Attorney, Agent, or Firm*—Adams & Wilks

(57) ABSTRACT

A vacuum pump apparatus has a casing and a base connected to the casing. The base has an opening communicating with an interior space of the casing. A heater is mounted on the base for heating the base to maintain a gas discharge path at a temperature high enough to prevent solidification of processed gas in the vacuum pump. A cover member covers the opening of the base. The cover member has a first surface communicating with the interior space of the casing and a second surface exposed to the exterior of the vacuum pump. A substrate is connected to the first surface of the cover member and has at least one circuit for controlling operation of the vacuum pump.

20 Claims, 2 Drawing Sheets

PRIOR ART

VACUUM PUMP

BACKGROUND OF THE INVENTION

1. Field of the Invention

The present invention relates to a vacuum pump and, more particularly, to a vacuum pump which is used when a process gas for a semiconductor manufacturing system, for example, is sucked and exhausted.

2. Description of the Related Art

In recent years, semiconductor devices such as memory and integrated circuit devices have been used extensively along with the development of electronics. Therefore, the demand for semiconductor manufacturing systems has experienced a sudden increase.

The semiconductor manufacturing system is provided with a high vacuum chamber in which etching or other work is performed. Generally, a vacuum pump is frequently used to evacuate the vacuum chamber.

The semiconductor device manufacturing processes include processes in which various kinds of process gases are applied to a substrate of a semiconductor, so that the vacuum pump is used not only to evacuate the vacuum chamber but also to suck and exhaust these process gases.

These process gases are sometimes introduced into the chamber in a high-temperature state to enhance the reactivity. However, these process gases are cooled during exhaustion, and thereby a chemical reaction takes place to form a solid product, which may adhere and accumulate in the vacuum pump.

For example, when silicon chloride ($SiCl_4$) is used as a process gas for an aluminum etching apparatus, in a low-vacuum region of 760 [torr] to $10^{-2}$ [torr] containing much water, the chemical reaction of silicon chloride is promoted, and thus aluminum chloride ($AlCl_3$) is precipitated as a solid product, and adheres and accumulates in the vacuum pump. In a low-temperature region of about 20° C., the chemical reaction of silicon chloride is further promoted.

In the vacuum pump, a rotor provided with a large number of rotor blades rotates at a high speed of several ten thousand revolutions per minute. If precipitates accumulate on a stator blade disposed on the inner peripheral surface of a casing of the vacuum pump, for example, a disadvantage of contact with the rotor blade may occur. Also, in some case, the accumulated precipitates narrow a gas discharge path, which remarkably degrades the performance of the vacuum pump.

Thereupon, methods for restraining the precipitation of a solid product in the vacuum pump have so far been proposed.

Generally, there is used a method in which heating is performed from the outside to increase the internal temperature of the vacuum pump, by which the adhesion of process gas is restrained. An example of this method is briefly explained with reference to a turbo-molecular pump shown in FIG. 2. A location at which the solid product of process gas is precipitated most easily in the turbo-molecular pump is a base 101 which has a high pressure and moreover is close to a water cooled tube 102 (for temperature control). Therefore, the base 101 is heated by using a heater 103 so as to be kept at a high temperature.

However, the above-described method using a heater presents a problem with a heat conduction path.

The conduction path of heat generated by the heater 103 is indicated by the arrow marks in FIG. 2. Thus, the heat generated by the heater 103 is transferred to a motor housing 106 and a substrate 104 located inside the vacuum pump through the base 101. Since a motor section 105 disposed in the motor housing 106 and the inside substrate 104 have a design limit temperature set considering reliability, the vacuum pump must be used in the value range of design limit temperature when the vacuum pump is operated. In particular, the design limit temperature of the substrate 104 is as low as 80° C.

Thus, in the conventional construction, if a heater is used for heating, the motor section and the inside substrate, which are not desired to be heated, are also heated. Therefore, the temperature of the substrate disposed in the motor housing increases undesirably.

SUMMARY OF THE INVENTION

Accordingly, an object of the present invention is to provide a vacuum pump in which a discharge path for process gas in the vacuum pump is kept at a higher temperature than before, and in which an inside substrate is cooled effectively.

To achieve the above object, the invention of a first aspect provides a vacuum pump including a body which has a casing and a base having an opening communicating with the casing and is provided with a gas intake port and a gas discharging port; a rotor pivotally supported in the body so as to be rotatable; a motor for driving the rotor; a motor housing for supporting the motor; gas transfer means, which is provided between the casing and the rotor, for transferring gas sucked through the gas intake port to the gas discharge port; heating means for heating a gas discharge path for the gas transferred by the gas transferring means; a back cover for covering the opening of the base; and a substrate which is arranged on the motor housing side of the back cover.

The heating means is composed of, for example, a heater disposed around the base or the casing or in the vacuum pump.

To achieve the above object, in the invention of a second aspect, the vacuum pump further includes cooling means for cooling the back cover.

To achieve the above object, in the invention of a third aspect, the back cover is fixed via a heat insulating material.

To achieve the above object, in the invention of a fourth aspect, the cooling means is a water cooled tube provided on the back cover to circulate cooling water.

To achieve the above object, in the invention of a fifth aspect, the heat insulating material is formed of a heat insulating ceramic material or resin.

According to the present invention, by arranging the substrate on the inside of the back cover, the inside substrate can be cooled efficiently.

Also, by providing the cooling means for cooling the back cover, the efficiency in cooling the substrate is improved.

Further, by arranging the heat insulating material in the connecting portion between the back cover and the base, the heat of the base heated intentionally by the heater can be prevented from conducting to the back cover.

Thus, if the efficient cooling of the inside substrate is effective, the temperature in the pump can be increased further as compared with the conventional vacuum pump. Therefore, the temperature of the gas discharge path for process gas can be made higher than before, and hence the accumulation of solid product in the vacuum pump can be restrained further.

DETAILED DESCRIPTION OF THE PREFERRED EMBODIMENTS

A preferred embodiment of the present invention will now be described in detail with reference to FIG. 1.

Figure 1:
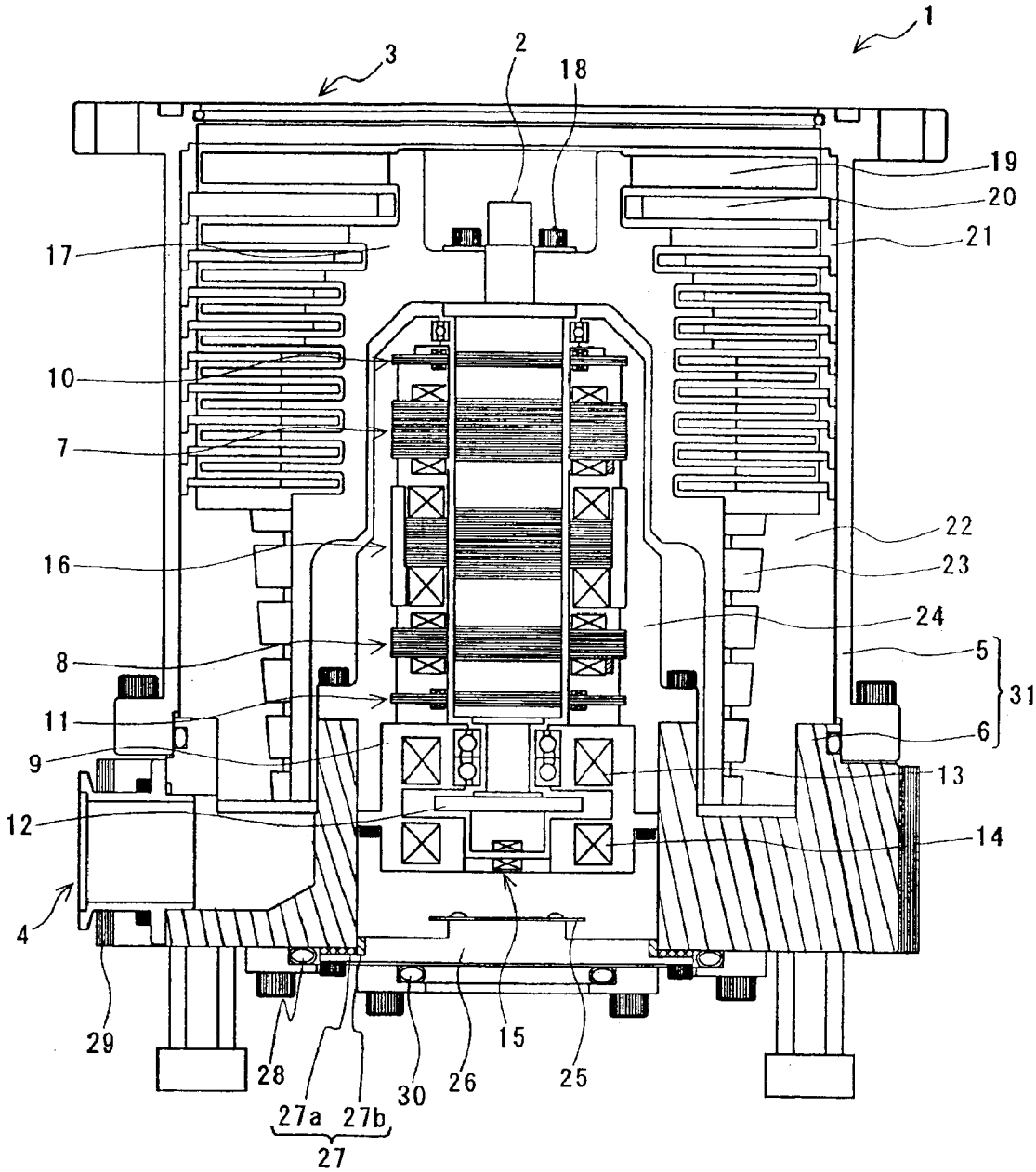
FIG. 1 is a sectional view of a turbo-molecular pump in accordance with the present invention.

FIG. 1 is a sectional view of a turbo-molecular pump in accordance with the present invention, showing a cross-section in the axial direction of a rotor shaft 2.

Although not shown in FIG. 1, a gas inlet or intake port 3 of a turbo-molecular pump 1 is connected to a vacuum chamber of a semiconductor manufacturing system via a conductance valve (a valve for regulating conductance, i.e., flowability of exhaust gas by changing the cross-sectional area of flow path of pipe) and the like, and a gas outlet or discharge port 4 is connected to an auxiliary pump.

A casing 5 that forms a casing for the turbo-molecular pump 1 has a cylindrical shape, and a rotor shaft 2 is disposed in the center thereof. The casing 5 constitutes a body 31 of the turbo-molecular pump 1 together with a base 6. The casing 5 has an interior space and the base 6 has an opening communicating with the interior space.

At the upper part, lower part, and bottom part in the axial direction of the rotor shaft 2, there are provided magnetic bearing portions 7, 8 and 9, respectively. The rotor shaft 2 is supported in the radial direction (radial direction of the rotor shaft 2) in a non-contact manner by the magnetic bearing portions 7 and 8, and is supported in the thrust direction (axial direction of the rotor shaft 2) in a non-contact manner by the magnetic bearing portion 9. These magnetic bearing portions 7, 8 and 9 constitute what is called a five-axis control type magnetic bearing, and the rotor shaft 2 has only the degree of freedom of rotation around the axis of the rotor shaft 2.

In the magnetic bearing portion 7, four electromagnets are arranged at 90° intervals around the rotor shaft 2 so as to be opposed to each other. The rotor shaft 2 is formed of a material with high magnetic permeability (for example, iron), and hence is attracted by a magnetic force of the electromagnet.

A displacement sensor 10 detects displacement in the radial direction of the rotor shaft 2. When detecting displacement of the rotor shaft 2 in the radial direction from a predetermined position by means of a displacement signal sent from the displacement sensor 10, a control section, not shown, operates to return the rotor shaft 2 to the predetermined position by regulating the magnetic force of each electromagnet. Thus, the magnetic force of electromagnet is regulated by feedback controlling the exciting current of each electromagnet.

The control section carries out feedback control of magnetic force of the magnetic bearing portion 7 by means of a signal sent from the displacement sensor 10. Thereby, the rotor shaft 2 is magnetically levitated in the radial direction in the magnetic bearing portion 7 with a predetermined clearance being provided with respect to the electromagnets, and is held in a space in a non-contact manner.

The construction and operation of the magnetic bearing portion 8 are the same as those of the magnetic bearing portion 7.

In the magnetic bearing portion 8, four electromagnets are arranged at 90° intervals around the rotor shaft 2, and the rotor shaft 2 is held in the radial direction in the magnetic bearing portion 8 in a non-contact manner by a suction force of magnetic force of the electromagnets.

A displacement sensor 11 detects displacement in the radial direction of the rotor shaft 2.

Upon receipt of a displacement signal in the radial direction of the rotor shaft 2 from the displacement sensor 11, the control section, not shown, carries out feedback control of the exciting current of electromagnet so as to hold the rotor shaft 2 at a predetermined position by correcting the displacement.

The control section carries out feedback control of magnetic force of the magnetic bearing portion 8 by means of a signal sent from the displacement sensor 11. Thereby, the rotor shaft 2 is magnetically levitated in the radial direction in the magnetic bearing portion 8 with a predetermined clearance being provided with respect to the electromagnets, and is held in a space in a non-contact manner.

Thus, since the rotor shaft 2 is held in the radial direction at two places of the magnetic bearing portions 7 and 8, the rotor shaft 2 is held at the predetermined position in the radial direction.

The magnetic bearing portion 9 provided at the lower end of the rotor shaft 2 is composed of a disk-shaped metallic disk 12, electromagnets 13 and 14, and a displacement sensor 15, and holds the rotor shaft 2 in the thrust direction.

The metallic disk 12, which is formed of a material with high magnetic permeability such as iron, is fixed perpendicularly to the rotor shaft 2 in the center thereof. Above and below the metallic disk 12, the electromagnet 13 and the electromagnet 14 are provided respectively. The electromagnet 13 attracts the metallic disk 12 upward by means of the magnetic force, and the electromagnet 14 attracts the metallic disk 12 downward. The control section suitably regulates the magnetic force applied to the metallic disk 12 by the electromagnets 13 and 14 so that the rotor shaft 2 is magnetically levitated in the thrust direction and held in a space in a non-contact manner.

The displacement sensor 15 detects displacement in the thrust direction of the rotor shaft 2, and sends the detection signal to the control section, not shown. The control section detects displacement in the thrust direction of the rotor shaft 2 based on the displacement detection signal received from the displacement sensor 11.

When the rotor shaft 2 moves either way in the thrust direction and is displaced from a predetermined position, the control section operates so that the magnetic force is regulated by feedback controlling the exciting currents of the electromagnets 13 and 14 so as to correct the displacement, by which the rotor shaft 2 is returned to the predetermined position. The control section continuously carries out this feedback control so that the rotor shaft 2 is magnetically levitated in the thrust direction at the predetermine deposition and held there.

The rotor shaft 2 is provided with a motor section 16 disposed in a motor housing 24 and between the magnetic bearing portions 7 and 8. In this embodiment, the motor section 16 is assumed to be formed of a dc brushless motor as an example.

In the motor section 16, a permanent magnet is fixed around the rotor shaft 2. This permanent magnet is fixed so that, for example, the N pole and S pole are arranged 180° apart around the rotor shaft 2. Around this permanent magnet, for example, six electromagnets are arranged at 60° intervals symmetrically and opposingly with respect to the axis of the rotor shaft 2 with a predetermined clearance being provided with respect to the rotor shaft 2.

Also, at the lower end of the rotor shaft 2, a rotational speed sensor, not shown, is installed. The control section, not shown, can detect the rotational speed of rotor shaft 2 based on the detection signal from the rotational speed sensor. Also, for example, near the displacement sensor 11, a sensor, not shown, is installed to detect the phase of rotation of the rotor shaft 2. The control section detects the position of the permanent magnet by using the detection signals of this sensor and the rotational speed sensor.

At the upper end of the rotor shaft 2, a rotor 17 is installed with a plurality of bolts 18.

As described below, a portion ranging from a substantially middle position of the rotor 17 to the gas intake port 3, that is, a substantially upper half portion in FIG. 1 is a molecular pump section, and a substantially lower half portion in the figure, that is, a portion ranging from a substantially middle position of the rotor 17 to the gas discharge port 4 is a screw groove pump section.

In the molecular pump section located on the gas intake port side of the rotor 17, rotor blades 19 are installed at a plurality of stages radially from the rotor 17 so as to be inclined through a predetermined angle from a plane perpendicular to the axis of the rotor shaft 2. The rotor blade 19 is fixed to the rotor 17 so as to be rotated at a high speed together with the rotor shaft 2.

On the gas intake port side of the casing 5, stator blades 20 are arranged toward the inside of the casing 5 alternately with the rotor blades 19 so as to be inclined through a predetermined angle from a plane perpendicular to the axis of the rotor shaft 2.

When the rotor 17 is driven by the motor section 16 and is rotated together with the rotor shaft 2, exhaust gas is sucked through the gas intake port 3 by the action of the rotor blades 19 and the stator blades 20.

The exhaust gas sucked through the gas intake port 3 passes between the rotor blade 19 and the stator blade 20, and is sent to the screw groove pump section formed in the lower half portion in the figure. At this time, the temperature of the rotor blade 19 is increased by friction between the rotor blade 19 and the exhaust gas and the conduction of heat generated in the motor section 16. This heat is transferred to the stator blade 20 by radiation or gas molecule of exhaust gas.

A spacer 21 is a ring-shaped member, and is formed of a metal such as aluminum, iron, stainless steel, copper, or an alloy containing these metals as components.

The spacer 21 is interposed between stages of the stator blades 20 to keep the stage formed by the stator blades 20 at a predetermined interval, and holds the stator blades 20 at predetermined positions.

The spacers 21 are connected to each other in the outer peripheral portion, and form a heat conduction path for conducting the heat that the stator blade 20 receives from the rotor blade 19 and the heat generated by friction between the exhaust gas and the stator blade 20.

The screw groove pump section formed on the gas discharge port side of the rotor 17 is composed of a rotor 17 and a screw groove spacer 22.

The screw groove spacer 22 is a cylindrical member formed of a metal such as aluminum, copper, stainless steel, or iron, or an alloy containing these metals as components, and has a plurality of spiral screw grooves 23 formed in the inner peripheral surface thereof.

The direction of spiral of the screw groove 23 is a direction such that when molecules of exhaust gas move in the rotation direction of the rotor 17, the molecules are transferred to the gas discharge port 4.

When the rotor 17 is driven and rotated by the motor section 16, the exhaust gas is transferred from the molecular pump section in the upper half portion in the figure to the screw groove pump section. The transferred exhaust gas is transferred toward the gas discharge port 4 while being guided by the screw groove 23.

A heater 29 is mounted on the outer peripheral surface of the base 6. The heater 29 is formed of an electrical heating member such as a nichrome wire, and is supplied with electric power from a temperature controller, not shown. The heater generates heat when being supplied with electric power, and heats the base 6. By heating the base 6, the temperature in a gas discharge path for process gas is kept at a high temperature, and thus the precipitation of solid product in the pump is restrained.

In the embodiment of the present invention, the heater 29 is mounted on the outer peripheral surface of the base 6 to heat the interior of a gas discharge path near the base 6, which meets the conditions (low temperature, high pressure) for easy precipitation of solid product of process gas. Therefore, even if the heater 29 is mounted on the outer peripheral surface of the casing 5, in which case the interior of gas discharge path can be heated, an effect of restraining the precipitation of solid product of process gas can be achieved. Also, the heater 29 can be incorporated directly in the turbo-molecular pump to heat the gas discharge path.

A cover member or back cover 26 is installed at the bottom of the base 6 for covering the opening of the base 6. Since it is exposed to the outside air, the back cover 26 is in a relatively low temperature state in the turbo-molecular pump.

On the inside of the back cover 26, there is arranged a substrate 25 in which various types of information on the vacuum pump are recorded. The substrate 25 comprises a substrate having circuits for controlling operation of the vacuum pump and in which pump operation time, error history, setting temperature for temperature control, etc. are stored. These circuits use a large number of semiconductor parts. Since the design limit temperature for the semiconductor part is set considering reliability, the semiconductor part must be used within the range of setting value of design limit temperature when the vacuum pump is operated. The design limit temperature is set at a value considering the guaranteed value of the parts maker and a margin.

Figure 2:
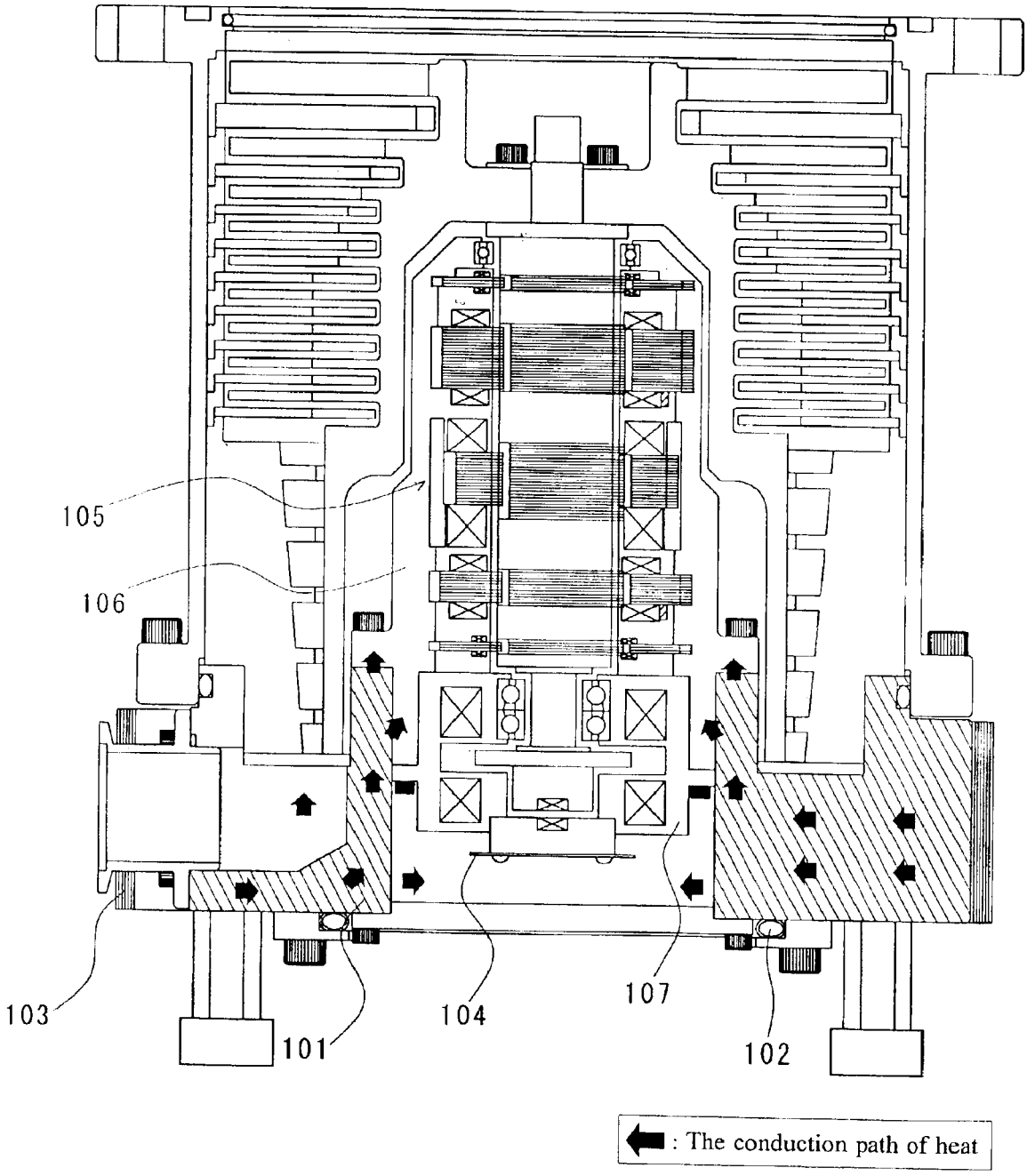
FIG. 2 is a sectional view of a conventional turbo-molecular pump.

The difference in arrangement position of the substrate 25 from that in the conventional vacuum pump can be seen by making comparison with the arrangement position of the substrate 104 in FIG. 2.

Since the substrate 104 in the conventional vacuum pump is attached to a magnetic bearing portion 107, the heat generated by a heater is transferred to the substrate 104 through a base 101, a motor housing 106, and the magnetic bearing portion 107, or the heat from a motor 106 is transferred to the substrate 104.

However, by locating the substrate 25 to the back cover 26, the aforementioned heat conduction path for heating the substrate 25 can be cut off. Thereby, a rise in temperature of the substrate 25 can be restrained.

Since the pump substrate 25 in the present invention is arranged on the inside of the back cover 26, the wires for the substrate 25 are designed so as to be longer than those in the conventional vacuum pump considering the efficiency of work for assembling the vacuum pump.

Although an example of a turbo-molecular pump using a magnetic bearing as a bearing has been described in the embodiment of the present invention, the present invention can also be applied to the case where, for example, a mechanical bearing is used.

As described above, the substrate 25 must be kept at a low temperature because of the parts mounted thereon. For this reason, a water cooled tube 30 is installed on the outside of the back cover 26, on which the substrate 25 is arranged, to forcedly cool the back cover 26 by circulating cooling water in the water cooled tube 30. Another water cooled tube 28 is arranged on a lower surface of the base 6 for cooling the base 6.

An effect of cooling the back cover 26 can also be achieved by providing a forced air cooling device such as a fan in place of the water cooled tube 30.

In a connecting portion 27*a* and a contacting portion 27*b* between the back cover 26 and the base 6, a heat insulating material 27 with low heat conductivity is arranged. The heat insulating material 27, which is an element for improving an effect of cooling the back cover 26 and an effect of heating the base 6, serves to interrupt the transfer of the heat of the base 6 heated by the heater 29 to the back cover 26. The heat insulating material is formed of a heat insulating ceramic material (for example, KO, nTiO, CaO, or SiO) or resin (for example, fluorine contained resin, acrylic resin, epoxy resin, or other high-temperature resins), or a metal with low heat conductivity (for example, stainless steel or chromium-nickel alloy ($18Cr_2Ni$).

The process gas sucked through the gas intake port 3 moves in the gas discharge path toward the gas discharge port 4 while the temperature thereof decreases. However, since the base 6 is heated by the heater 29, the process gas can be prevented from adhering and accumulating near the base 6 as a solid product.

Also, since the substrate 25 is arranged on the inside of the back cover 26, the back cover 26 can be cooled efficiently by being cooled forcedly from the outside.

What is claimed is:

1. A vacuum pump comprising:

a body comprised of a casing having an interior space, a base connected to the casing and having an opening communicating with the interior space of the casing, a gas intake port for introducing gas molecules into the interior space of the casing, and a gas discharging port for discharging the gas molecules from the interior space of the casing;

a rotor supported in the body for undergoing rotation;

a motor for rotating the rotor;

a motor housing disposed in the body for supporting the motor;

gas transfer means disposed between the casing and the rotor for transferring gas molecules from the gas intake port to the gas discharge port through a gas discharge path;

heating means for heating the gas discharge path;

a cover member for covering the opening of the base, the cover member having a surface communicating with the interior space of the casing; and a substrate connected to the surface of the cover member.

2. A vacuum pump according to claim 1; further comprising cooling means for cooling the cover member.

3. A vacuum pump according to claim 2; wherein the cooling means comprises a water cooled tube mounted on the cover member for circulating cooling water to cool the cover member.

4. A vacuum pump according to claim 1; wherein the cover member is connected to the base; and further comprising a heat insulating material disposed between the cover member and the base.

5. A vacuum pump according to claim 2; wherein the cover member is connected to the base; and further comprising a heat insulating material disposed between the cover member and the base.

6. A vacuum pump according to claim 3; wherein the cover member is connected to the base; and further comprising a heat insulating material disposed between the cover member and the base.

7. A vacuum pump according to claim 4; wherein the heat insulating material comprises a heat insulating ceramic material or resin.

8. A vacuum pump according to claim 5; wherein the heat insulating material comprises a heat insulating ceramic material or resin.

9. A vacuum pump according to claim 6; wherein the heat insulating material comprises a heat insulating ceramic material or resin.

10. A vacuum pump according to claim 1; wherein the heating means is mounted on an outer peripheral surface of the base for heating the base and the gas discharge path.

11. A vacuum pump comprising:

a body comprised of a casing having an interior space, a base connected to the casing and having an opening communicating with the interior space of the casing, an inlet port for introducing gas molecules into the interior space of the casing, and an outlet port for discharging the gas molecules from the interior space of the casing;

a rotor supported in body for undergoing rotation;

a motor for rotating the rotor;

gas transfer means disposed between the casing and the rotor for transferring gas molecules from the inlet port to the outlet port through a gas discharge path;

a heater mounted on the base for heating the base to maintain the gas discharge path at a temperature high enough to prevent solidification of processed gas in the vacuum pump;

a cover member covering the opening of the base, the cover member having a first surface communicating with the interior space of the casing and a second surface exposed to the exterior of the vacuum pump; and a substrate connected to the first surface of the cover member and having at least one circuit for controlling operation of the vacuum pump.

12. A vacuum pump according to claim 11; further comprising heat insulating means for preventing heat transfer from the base to the cover member.

13. A vacuum pump according to claim 12; wherein the cover member is connected to the base; and wherein the heat insulating means comprises a heat insulating material disposed between connecting portions of the cover member and the base.

14. A vacuum pump according to claim 13; wherein the heat insulating material comprises a heat insulating ceramic material.

15. A vacuum pump according to claim 13; wherein the heat insulating material comprises a heat insulating resin.

16. A vacuum pump according to claim 11; further comprising cooling means for cooling the cover member.

17. A vacuum pump according to claim 16; wherein the cooling means comprises a water cooled tube for circulating cooling water to cool the cover member.

18. A vacuum pump according to claim 11; further comprising first cooling means for cooling the cover member and second cooling means for cooling the base.

19. A vacuum pump according to claim 18; wherein the first and second cooling means comprise water cooled tubes each for circulating cooling water to cool the cover member and the base, respectively.

20. A vacuum pump comprising:

a casing having an interior space, an inlet port for introducing gas molecules into the interior space of the casing, and an outlet port for discharging the gas molecules from the interior space of the casing;

a base connected to the casing and having an opening communicating with the interior space of the casing;

a rotor supported in the casing for undergoing rotation;

a motor for rotating the rotor;

a rotor shaft connected to the rotor for rotation therewith;

a magnetic bearing having a first magnetic bearing portion for supporting the rotor shaft in a radial direction thereof and a second magnetic bearing portion for supporting the rotor shaft in an axial direction thereof;

a cover member covering the opening of the base, the cover member having a surface disposed opposite to and generally confronting the second magnetic bearing portion of the magnetic bearing;

a substrate connected to the surface of the cover member and having at least one circuit for controlling operation of the vacuum pump; and gas transfer means disposed between the casing and the rotor for transferring gas molecules from the inlet port toward the outlet port.

* * * * *